US007270329B2

(12) United States Patent
Barthold

(10) Patent No.: US 7,270,329 B2
(45) Date of Patent: Sep. 18, 2007

(54) DESIGN GAME WITH DEDUCTIVE COMPONENT

(75) Inventor: Mark Barthold, Torrance, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 11/208,169

(22) Filed: Aug. 19, 2005

(65) Prior Publication Data

US 2006/0038345 A1 Feb. 23, 2006

Related U.S. Application Data

(60) Provisional application No. 60/603,895, filed on Aug. 23, 2004.

(51) Int. Cl.
*A63F 1/00* (2006.01)

(52) U.S. Cl. ..... 273/276; 273/430

(58) Field of Classification Search ..... 273/273, 273/276, 429, 430, 431, 432, 292, 293, 308, 273/153 R, 156, 157 R; 434/322; 446/85
See application file for complete search history.

(56) References Cited

U.S. PATENT DOCUMENTS

| | | | | |
|---|---|---|---|---|
| 2,363,914 | A | 11/1944 | Wakefield | |
| 2,465,971 | A | 3/1949 | Leblang | |
| 2,843,970 | A | 7/1958 | Keuls | |
| 3,234,681 | A | 2/1966 | De Lucia | |
| 3,468,540 | A * | 9/1969 | Mulligan | 273/256 |
| 3,660,926 | A | 5/1972 | Lerner et al. | |
| 3,726,027 | A | 4/1973 | Cohen et al. | |
| 3,817,531 | A * | 6/1974 | King et al. | 273/243 |
| 3,863,386 | A | 2/1975 | Kinberg | |
| 4,030,736 | A | 6/1977 | Petrusek | |
| 4,112,614 | A | 9/1978 | Clokey | |
| 4,122,628 | A | 10/1978 | Crowell et al. | |
| 4,124,214 | A | 11/1978 | Pavis | |
| 4,261,012 | A | 4/1981 | Maloomian | |
| 4,434,467 | A | 2/1984 | Scott | |
| 4,539,585 | A | 9/1985 | Spackova et al. | |
| 4,639,235 | A | 1/1987 | Ibe | |
| 4,669,611 | A * | 6/1987 | Flaherty | 206/442 |
| 4,671,514 | A | 6/1987 | Wilson-Diehl | |
| 4,776,823 | A | 10/1988 | Hanlon | |
| 4,798,556 | A | 1/1989 | Vicars et al. | |
| 4,846,689 | A | 7/1989 | Day | |
| 4,927,147 | A | 5/1990 | Delzio | |
| 4,948,146 | A * | 8/1990 | Snyder et al. | 273/273 |
| 5,110,140 | A | 5/1992 | Breslow et al. | |
| 5,123,870 | A | 6/1992 | Cahill | |
| 5,178,573 | A | 1/1993 | Smith | |
| 5,197,884 | A * | 3/1993 | Roemer et al. | 434/178 |
| 5,507,497 | A * | 4/1996 | Sivak | 273/429 |
| 5,666,712 | A | 9/1997 | Cvetkov | |
| 5,746,639 | A | 5/1998 | Bloom et al. | |
| 5,785,528 | A | 7/1998 | Jones-Fenleigh et al. | |

(Continued)

*Primary Examiner*—William M. Pierce
(74) *Attorney, Agent, or Firm*—Kolisch Hartwell, P.C.

(57) ABSTRACT

A game of deduction including game components and rules for playing a game for a plurality of players, a goal of which may be for one player to deduce, through a question and answer process, an image on a game card chosen by another player. A game board, multiple game cards, and a set of image elements with an accompanying game palette may be suitable for playing the game of deduction.

8 Claims, 6 Drawing Sheets

U.S. PATENT DOCUMENTS

| | | | |
|---|---|---|---|
| 5,820,383 | A | 10/1998 | Levins |
| D428,626 | S | 7/2000 | Wokoske |
| 6,120,026 | A | 9/2000 | Whitney et al. |
| 6,280,283 | B1 | 8/2001 | Sisler |
| 6,540,518 | B1 | 4/2003 | Shepherd |
| 6,604,976 | B2 | 8/2003 | Lenkoff |
| 2002/0022506 | A1 | 2/2002 | Rifkin |

* cited by examiner

DESIGN GAME WITH DEDUCTIVE COMPONENT

CROSS-REFERENCE TO RELATED APPLICATIONS

This application is based upon and claims priority under 35 U.S.C. § 119(e) to U.S. Provisional Patent Application Ser. No. 60/603,895, filed Aug. 23, 2004 and entitled "Design Game." U.S. Provisional Patent Application Ser. No. 60/603,895 is incorporated herein by reference in its entirety for all purposes.

FIELD OF THE DISCLOSURE

The present disclosure relates generally to games of deduction and devices useable for playing such games. An object of the design game may be for a first player to guess a design chosen by a second player.

BACKGROUND OF THE DISCLOSURE

Examples of card and design games, including games having playing surfaces suitable for making a design, may be found in U.S. Patents and Patent Application Publications numbered: U.S. Pat. Nos. 2,363,914; 2,465,971; 2,843,970; 3,234,681; 3,660,926; 3,726,027; 3,863,386; 4,030,736; 4,112,614; 4,122,628; 4,124,214; 4,261,012; 4,434,467; 4,539,585; 4,639,235; 4,671,514; 4,776,823; 4,798,556; 4,846,689; 4,927,147; 5,110,140; 5,123,870; 5,178,573; 5,666,712; 5,746,639; 5,785,528; 5,820,383; 6,120,026; 6,280,283; 6,540,518; 6,604,976; D428,626; US2002/0022506. The disclosures of the aforementioned patents and patent publications are incorporated herein by reference in their entirety for all purposes.

SUMMARY

A design game may use a plurality of game boards, a plurality of game cards, and a plurality of image elements that may be removably adhered to the game boards. The game board may be configured to transition from a closed to an open position, where the open position may be used as a play surface onto which flexible, removable image elements may be placed. A number of game cards may provide variability in game play, and may be used to determine a design to be reproduced on one or more game boards.

In an illustrated embodiment, indicia used in a design game may be based on characters and items appearing in a Barbie™ collection of toys and games.

The present disclosure will be understood more readily after consideration of the drawings and the Detailed Description.

DETAILED DESCRIPTION

The present disclosure relates to a design game playable by two or more players. In an illustrated embodiment, two or more players may choose cards from a deck of cards. The players may take turns asking questions of each other as a way for a first player to deduce the characteristics of an image shown on a card possessed by a second player. Utilizing a game surface, the first player may attempt to re-create the design shown on the card of the second player. The player who successfully re-creates a design shown on the card of another player may be declared winner of the game.

Figure 1:
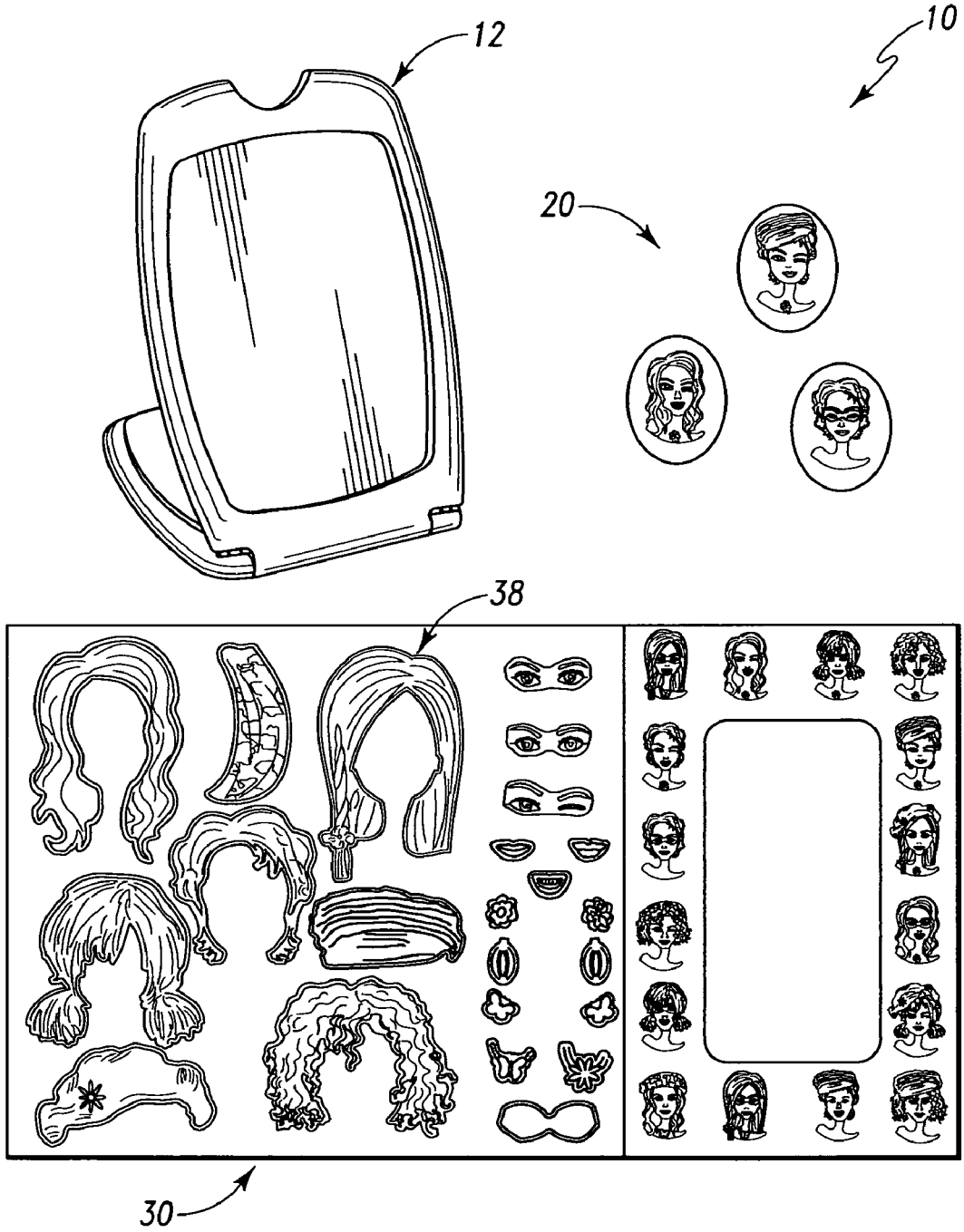
FIG. 1 depicts one embodiment of a game board and associated components of a design game.

FIG. 1 shows generally, at 10, an overview of game components for a design game. The game components may include, for example, a game board 12, a set of cards 20, one or more game palettes 30 and a number of image elements 38. In addition, game play utilizing the game of the present disclosure may include inter-player interaction in the form of a series of questions and answers.

Figure 2:
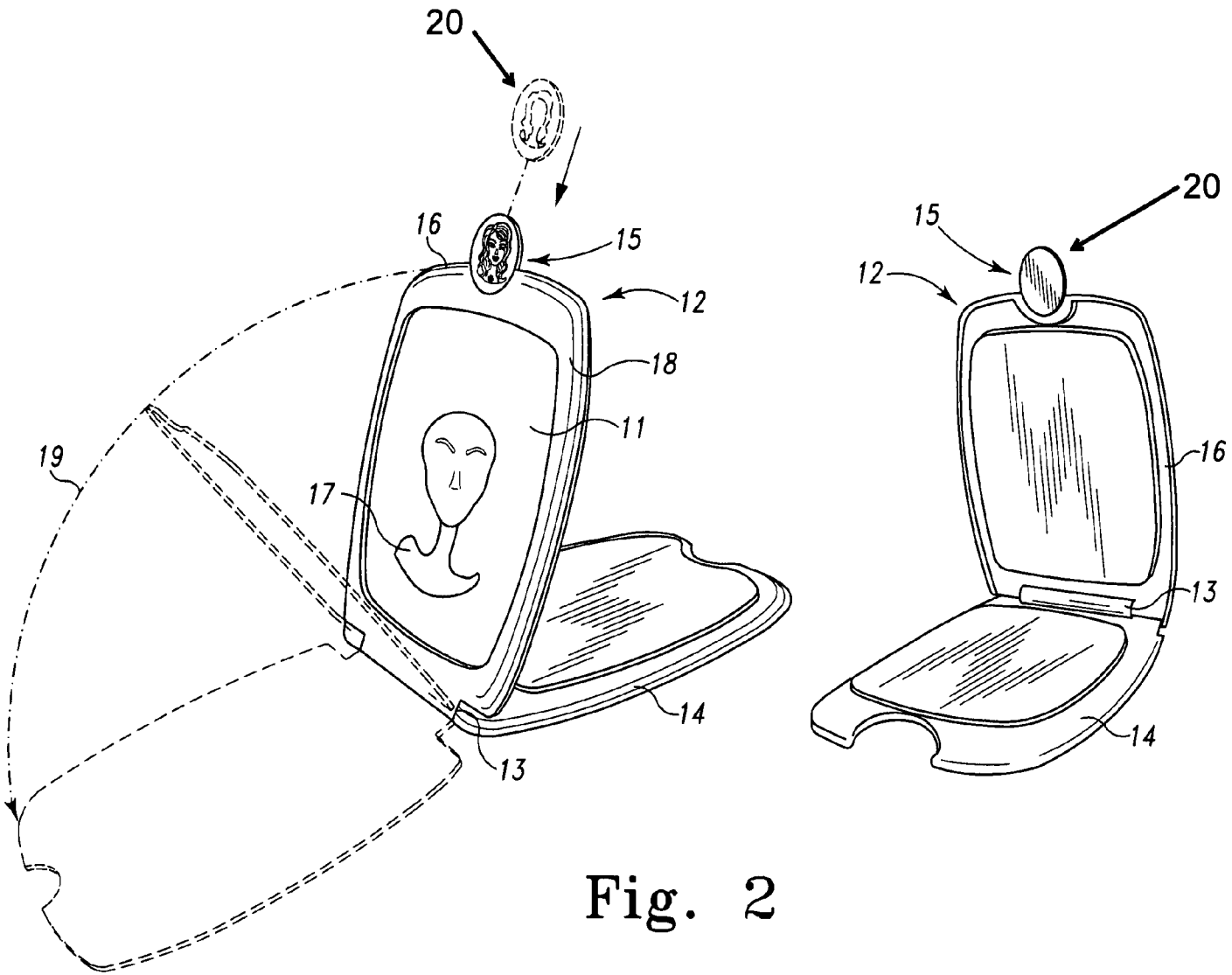
FIG. 2 depicts front and rear perspective views of two embodiments of game boards.

FIG. 2 shows, in more detail, a front perspective view of an embodiment of a game board 12 and a rear perspective view of a second embodiment. Game board 12 may be configured to give an outward appearance of being a compact-type mirror, such as a mirror generally designed to contain make-up as it is being carried in a purse. Game board 12 may be configured to open in a "clamshell" manner along motion line 19, wherein a display section 16 and a base section 14 pivot about a hinge 13. Movement about hinge 13 may allow game surface 11, which may be an integral component of display section 16, to be positioned adjacent to base 14 when the game board is not in use. This may protect the display section and may reduce the amount of space taken up by the game board. Game surface 11 may occupy at least a portion of display section 16 and may be surrounded by a border 18. Game surface 11 may be marked with all or a portion of an image 17 for use in a game. A portion of display section 16 may be configured as a receptacle for a card 20 and thereby function as a card holder 15.

As previously noted, game board 12 may give the appearance of a compact-type mirror and the game board may be configured as a clamshell-type device. A clamshell-type game board may be designed such that when it is opened to approximately a 270-degree or greater angle, it becomes a self-supporting structure and exposes a game surface 11 to a game player or players. Alternatively, the game board may open to any angle suitable for playing a game. A clamshell-type design for game board 12 may allow the game board also to be a container for other game components. Further, it may make the game board easy to open, and it may make the game board sturdy, among other attributes. In a disclosed configuration, game board 12 may include a base section 14 and a display section 16 joined at a common hinge 13. Hinge 13 may be any suitable structure which allows display section 16 and base section 14 to be moved relative to each other in achieving open and closed configurations. In some embodiments, hinge 13 may ratchet, allowing base section 14 and display 16 to be held fixedly in multiple positions relative to each other. Game board sections 14, 16 may be solid, or they may have hollowed-out interiors, or they may have any other appropriate design or construction. The appearance of game board sections 14, 16 may be enhanced by decorative printing, or the sections may be without decoration. In some embodiments, at least a portion of display section 16 may function as a card holder 15. Card holder 15 may be configured in any manner to accommodate at least a portion of a game card 20 and hold the card in position during game play. Card holder 15 may be at any location on game board 12, though card holder 15 is an integral part of an upper portion of display section 16 in the illustrated embodiment. When located at an upper portion of display section 16, card holder 15 may hold a game card 20 such that it is easily seen by a player using game board 12.

As shown in FIGS. 1 and 2, game surface 11 may be an integral part of base section 14 or display section 16 of the game board. Game surface 11 of game board 12 may be exposed upon a player opening the game board, or it may remain exposed when the game board is in a closed position. In the illustrated embodiment, game surface 11 is protected by base section 14 when the game board is in a closed position. Game surface 11 may be configured such that it provides a surface upon which to play a design game. Game surface 11 may be a surface to which image elements 38 (see FIG. 4) may removably adhere, such as due to electrostatic charge or a pressure adhesive. For example, game surface 11 may be made of plastic, rubber, acrylic, or of any other appropriate material for playing the design game. Game surface 11 may or may not occupy a full portion of a game board section 14 or 16. In a situation where game surface 11 is only a portion of a game board section 14 or 16, the game surface may be surrounded by a border 18. A border 18 may be a decorative border, or it may contain information relevant to game play, or it may simply be an undecorated portion of a game board section 14 or 16.

Figure 3:
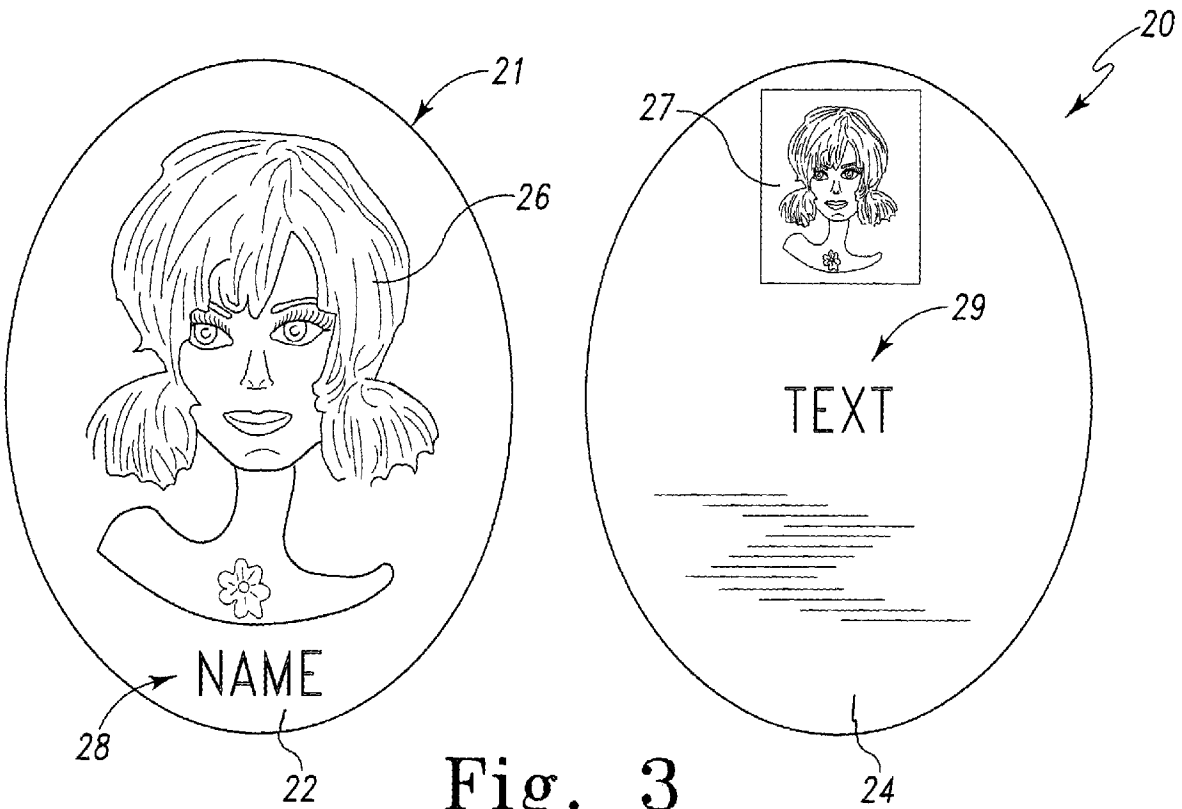
FIG. 3 depicts one embodiment of a card from a plurality of cards.

A set of game components may include a number of game cards 20, shown in FIG. 3. A deck of game cards may consist of a plurality of game cards 20. The game cards may be configured similarly to standard playing cards, or they may differ in one or more respects. In an illustrated embodiment, game cards 20 may be defined by a perimeter 21 having an ovoid shape. In other embodiments, perimeter 21 of the game cards may be of another suitable construction or design. In still other embodiments, a number of game cards may have differently shaped perimeters. A game card may have a front side 22 and a back side 24. Game cards 20 may be chosen randomly by players of a game or, alternatively, the game cards may be chosen according to some preference of each player. For example, if the game cards have unique images 26 and/or 27 printed upon at least one of their surfaces (see below), a player could choose a first game card based on a preference for an image on the first card versus an image on a second card.

A game card 20 may have front and back sides 22 and 24. The front side 22 of a game card may contain a game-play-related image 26. For example, a game-play-related image 26 may be an image of a face or other interesting design to be guessed by a player. An image of a face on the front side of a card may be accompanied by text 28 defining a descriptive name. A back side 24 of a game card may contain a second text component 29. In addition, a back side 24 may contain a game-related image 27, distinctive coloring scheme, or other decorative design.

A given game card 20 may include a number of distinguishing features. For example, a first game card may be distinguished from other game cards in containing a unique image 26 or 27 on at least one game card surface 22 or 24. Alternatively, or in addition, one game card may be distinguished from other game cards by containing a uniquely shaped perimeter 21. As another possibility, a first game card may be distinguished from other game cards by a unique text component 28 or 29 upon one or more surfaces 22, 24 of the first card. In an illustrated embodiment, a first game card may be distinguished from other game cards in a deck of game cards in containing at least one unique image 26 or 27 on one of a front or back surface 22 or 24.

A text component 28 or 29 may be present on at least one surface of a game card 20. Text 28 or 29 may be any suitable text for distinguishing one game card from another. For example, if image 26 is an image of a face, text 28 may be a unique name associated with the face image. Alternatively, text 28 may be some other descriptive word associated with the face image. In other embodiments, text 28 may have no specific association with the face image. Text 29 may be present on a second surface not already containing text 28. Text 29 may be a text component that is present on each game card 20, such that each game card has a common text element on one of its surfaces. For example, text 29 may be a name of a design game, such that the game cards of the design game may be associated as a set of game cards. Alternatively, text 29 may be any other wording suitable for placement on a game card 20. Depending upon the specific configuration of a game embodiment, it may not be necessary for text 29 to be unique among, or present on, game cards 20 if text 28 or image 26 or 27 already supplies a unique component to a game card. In the illustrated embodiment, unique text 28 may appear on a front surface 22 of a game card 20 with an associated face image 26, while text 29 is not present.

Figure 4:
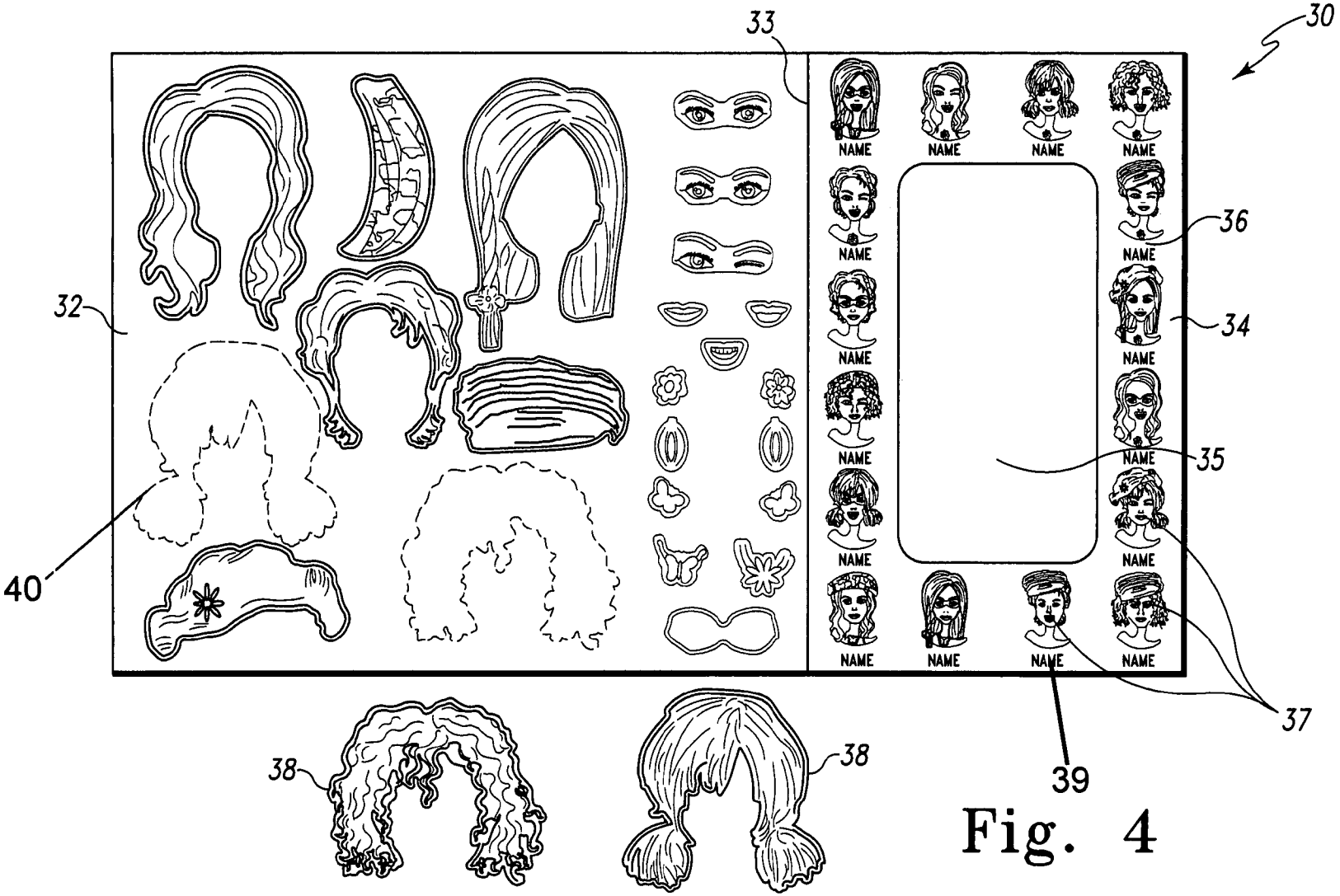
FIG. 4 depicts one embodiment of various game components.

Shown in FIG. 4 are a game palette 30 and a number of image elements 38 for use in a design game. Game palette 30 may be configured to include both a selection area 32 and a discard area 34. Selection and discard areas 32, 34 may both be locations suitable for storing image elements 38. Palette 30 may also include a peripheral portion 36, which may be a location containing a number of images similar to or the same as previously-discussed images 26 present on game cards 20 (see FIG. 3).

A game palette 30 may serve as a repository for image elements 38 and may be a location where a game player organizes various image elements. Image elements 38 may be distributed randomly about palette 30, or the image elements may be placed on the palette in an organized manner. Game palette 30 may be made of any suitable material for being a sturdy game play location. For example, palette 30 may be made of heavyweight card stock, thick cardboard, plastic, rubber, or any other suitable material. In some embodiments, palette 30 may be made of a single piece of board material, while in other embodiments palette 30 may be made of two or more pieces of board material. Palette 30 may be configured as a single, inflexible component, or it may be configured as a component that may be folded or arranged into different shapes for game play or game storage. Palette 30 may be a single undecorated piece of material, or it may be overlaid with a colorful design of some sort. In some embodiments, palette 30 may be painted, or etched, or otherwise modified. In other embodiments, palette 30 may have a covering sheet fastened to it, such as a fastened-on piece of paper or other suitable material. In the illustrated embodiment, palette 30 may be of card stock material with a fastened-on decorative overlay. Such an overlay may be configured to be compatible with image elements 38, such that image elements 38 may be removably adhered to palette 30 in a similar fashion as the image elements may be removably adhered to game surface 11.

Game palette 30 may be configured as having a selection area 32 and a discard area 34. Discard area 34 may further have a central portion 35 and a peripheral portion 36. In some embodiments, there may be no clear demarcation between selection area 32 and discard area 34. In an illustrated embodiment, selection area 32 and discard area 34 may be distinguished from each other by each having a distinctive appearance and by the presence of a dividing element at a position on the surface of palette 30, such as a dividing line 33 near the center of the palette. Selection area 32 may be a portion of palette 30 where a number of image elements 38 are stored at a beginning of the game. Discard area 34 may be a portion of palette 30 to which image elements are moved during the course of game play. As noted earlier, discard area 34 may be configured as having both a central portion 35 and a peripheral portion 36. The central portion 35 of discard area 34 may be a location where a player places a image element 38 after removing it from selection area 32 and after deciding not to place it on game surface 11. As such, the central portion 35 of discard area 34 may help a player keep track of a number of image elements 38 that the player has considered using during game play and which they have decided not to use in constructing an image on game surface 11. A peripheral area 36 of discard area 34 may be a location where a number of images 37 are present. Such images 37 may be related to images 26 present on a surface of a game card 20 (see FIG. 3) or they may be decorative images, or they may take the form of entertaining symbols. In an illustrated embodiment, images 37 on discard area 34 may correspond to images 26 on game cards 20 such that each image 26 on a game card may be represented by an identical image 37 on a peripheral portion 36 of discard area 34. Each image 37 may be accompanied by a text element 39. Text 39 may be descriptive text for image 37, or it may be other entertaining text. Alternatively, text 39 may be a name associated with image 37. In an illustrated embodiment, if an image 37 is identical to an image 26, then text 39 associated with image 37 may be identical to text 28 associated with image 26.

A number of image elements may be provided for game play with the game of the present disclosure. Image elements 38 may be configured to be stored within game board 12 or they may be configured to be stored on palette 30 or any other suitable storage device before, during, or after game play. If stored on a palette 30, each image element may be stored at defined location 40 on the palette, such that a player knows where to find a given element. Location 40 may be denoted by a marking on palette 30, or location 40 may simply be an area of sufficient size to hold a given element. Image elements 38 may be configured to give the appearance of being different components of an image 26 printed on a game card 20, described above. For example, it may be that a subset of image elements 38 may be used to re-create an image 26 present on a game card. In an illustrated embodiment, an image 26 on a game card may take the form of a unique face, and a set of image elements 38 may be configured such that they may be used to re-create each image present on the cards in a deck of game cards. For example, a set of image elements for use in a design game may include elements having the appearance of hair, headwear, eyes, a mouth, jewelry or other articles of adornment, or any other appropriate feature. For use with a game surface 11 described above, image elements 38 may be configured such that they may removably adhere to the game surface and to palette 30. In an illustrated embodiment, game surface 11 and palette 30 may have a surface to which image elements 38 may removably adhere, for example through a "static cling"-type interaction. Alternatively, image elements 38 may adhere to the game surface and the palette through magnetic or adhesive attraction, if the game surface and palette are suitably configured.

Another component of a design game is a question-and-answer interaction between game players. A question-and-answer portion of the game may involve a "20 questions"-type interaction between the players, wherein a first player and a second player may ask questions of each other as a way for each player to determine the characteristics of an image 26 on a game card 20 chosen by the other player. In this way, players may use deductive reasoning to determine the characteristics of an image 26 on another player's game card 20 and to reproduce that image 26 on their own game surface 11 using at least a subset of image elements 38. A question-and-answer interaction may involve a first player asking a question of a second player and phrasing the question such that it may be answered with a "yes" or "no" response. Given a response, the first player may then make a guess about the presence or absence of a specific component of an image on the second player's chosen game card. The second player may then question the first player. Continuing this pattern, the players may proceed until one of them has successfully deduced the image on the game card of another and reproduced it on their own game surface.

Having described, separately, many of the components of a game, there follows a description of possible game play with the described game board and components.

In an illustrated embodiment, the disclosed game board and components may be used to play a "Barbie™ Guess the Look" game. An object of the game may be for a first player to deduce, through question-and-answer interaction with a second player, the appearance of an image present on a game card chosen by the second player. Upon deducing the appearance of an image on a second player's card, the first player may re-create that image on a game surface 11 of the first player's game board 12 using at least a subset of image elements 38. In an illustrated embodiment, the image deduced and re-created may be an image of a face.

Game components used in a design game played by two players may include: 2 compact mirror-type game boards, 2 palettes, 16 game cards, and 46 image elements. The quantity of game components used may be suitably increased for games involving more than two players. Game play may begin with an allocation of game components among the game players. For example, each player may choose or be provided with a game board 12, in the form of a compact-type fold-out mirror, a set of image elements 38 and a palette 30.

In preparing for a game, a player may set up their game surface 11 by opening their game board 12 to an angle that may be approximately or a little more than 270 degrees (see motion line 19 in FIG. 2). When the player opens their game board as described, the player may expose game surface 11 such that it faces the player and is ready for use. In an illustrated embodiment, a game surface 11 of a game board 12 may give the appearance of being a mirror, and it may include an image of a portion of a person's torso 17. In addition to exposing game surface 11, opening game board 12 to an angle that may be approximately 270 degrees may allow a first portion of the clamshell-type game board, base section 14, to serve as a sturdy support for a second portion of the game board, display section 16, where the display section 16 may have playing surface 11 as one of its integral parts.

Game players may each prepare a palette 30 for use before beginning an interactive portion of the game. The palette may have two distinct halves, as discussed above. Game players may utilize the palette in a manner such that all image elements begin a game on a selection area 32 of the palette. As players progress through an interactive portion of a game and eliminate or confirm the use of one or more image elements 38, they may move image elements from the selection area 32 of the palette to a discard area 34 of the palette. In this way, each player may more easily keep track of which image elements may need to be used to compose a final image on game surface 11.

In beginning game play, a player may be required to choose a single game card 20 from a deck of a plurality of those cards. A game card may be chosen at random by a player, or it may be chosen by a preference of the player. In an illustrated embodiment, a number of game cards may be arranged image-side down so that players may choose a card without regard to the appearance of image 26 on the card. An order in which players choose a game card from a deck of game cards may be determined by chance, or it may be determined through some other means. For example, the order may be determined by a roll of a provided die, or the order may be determined by the ages of the players of the game. In an illustrated embodiment, a number of players may each choose a card following an order determined by the ages of the players, with a youngest player choosing a game card first. When each player has chosen a card, each player may place the card they have chosen in a card holder 15 on a display section 16 of his or her own game board. In an illustrated embodiment, each player may place their chosen card in the card holder such that a front surface of the card, carrying a unique image, can only be seen by the player who chose the card.

When players have organized and set up a complement of game components, they may begin an interactive portion of game play. In an interactive portion of game play, a first player may ask a question of and receive an answer from a second player, with the players taking turns asking questions. An interactive portion of game play may be a way for the first player to determine a set of image elements he or she will need to use, from the full collection of their image elements, to compose a face that matches the face shown on the game card chosen by the second player. In an illustrated embodiment, the first player may ask of the second player a question that can be answered with either a "yes" response or a "no" response. When the second player has answered a question from the first player, the second player may then ask a question of the first player that can be answered with a "yes" or "no" response.

An exemplary question from a first player to a second player may be: "Is your character wearing a necklace?" To which the second player may respond: "No." At that time, the first player may eliminate all the "necklace" image elements from consideration by moving them from a selection area 32 of a palette to a discard area 34 of the palette. On the other hand, if the second player answered "yes" to the above question, then the first player may either ask further questions about the type of necklace or may place a last remaining necklace, if there is only one remaining, on the torso image 17.

As a first player asks a series of questions and receives a series of answers, the player may decide to utilize some image elements in constructing a deduced face and may decide not to utilize other image elements. The first player may place onto a game surface, in an organized manner, the image elements he or she has decided to utilize in further game play. By placing the chosen image elements about an image of a torso 17 on a game surface, a player may construct an image resembling a face and upper torso of a person. When the first player has asked a number of questions and received a number of answers and feels that he or she has correctly deduced the appearance of an image on a game card chosen by a second player, the first player may make the deduced face available for inspection by the second player or any other players. If the face deduced and constructed by the first player is identical to the face present on the game card of the second player, then the first player may be declared a winner of the game.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

Inventions embodied in various combinations and subcombinations of features, functions, elements, and/or properties may be claimed through presentation of new claims in a related application. Such new claims, whether they are directed to a different invention or directed to the same invention, whether different, broader, narrower or equal in scope to the original claims, are also regarded as included within the subject matter of the inventions of the present disclosure.

Figure 5:
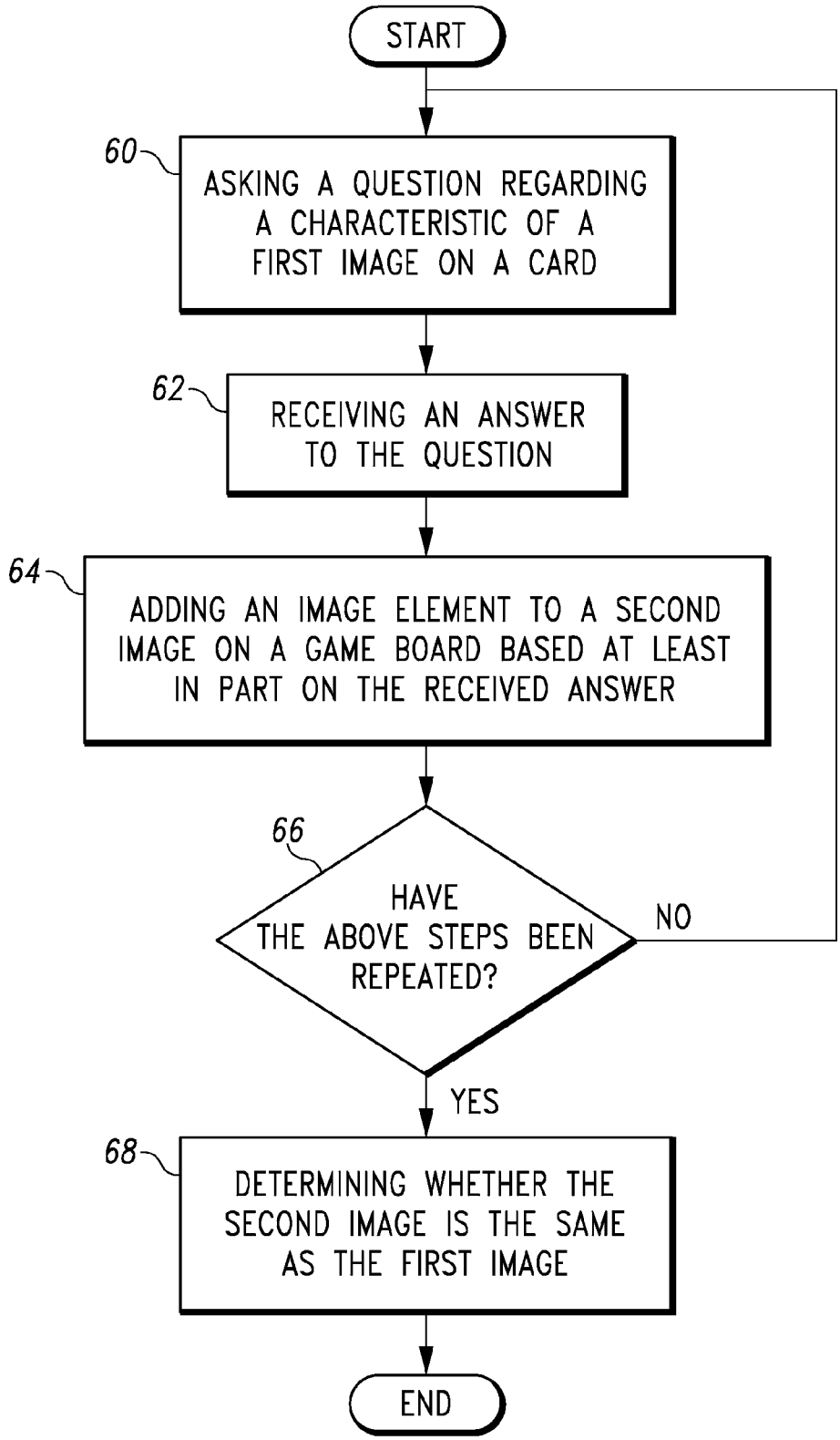
FIG. 5 is a flow chart for a method of playing a game of deduction.

An example of a method of playing a game of deduction is shown in FIG. 5. The method may include asking a question regarding a characteristic of a first image on a card, as indicated in block 60; receiving an answer to the question, as indicated in block 62; adding an image element to a second image on a game board based at least in part on the received answer, as indicated in block 64; if the steps of asking, receiving and adding have not been repeated, as indicated in block 66, repeating the steps of asking, receiving and adding; and after repeating the steps, determining whether the second image is the same as the first image, as indicated in block 68.

Figure 6:
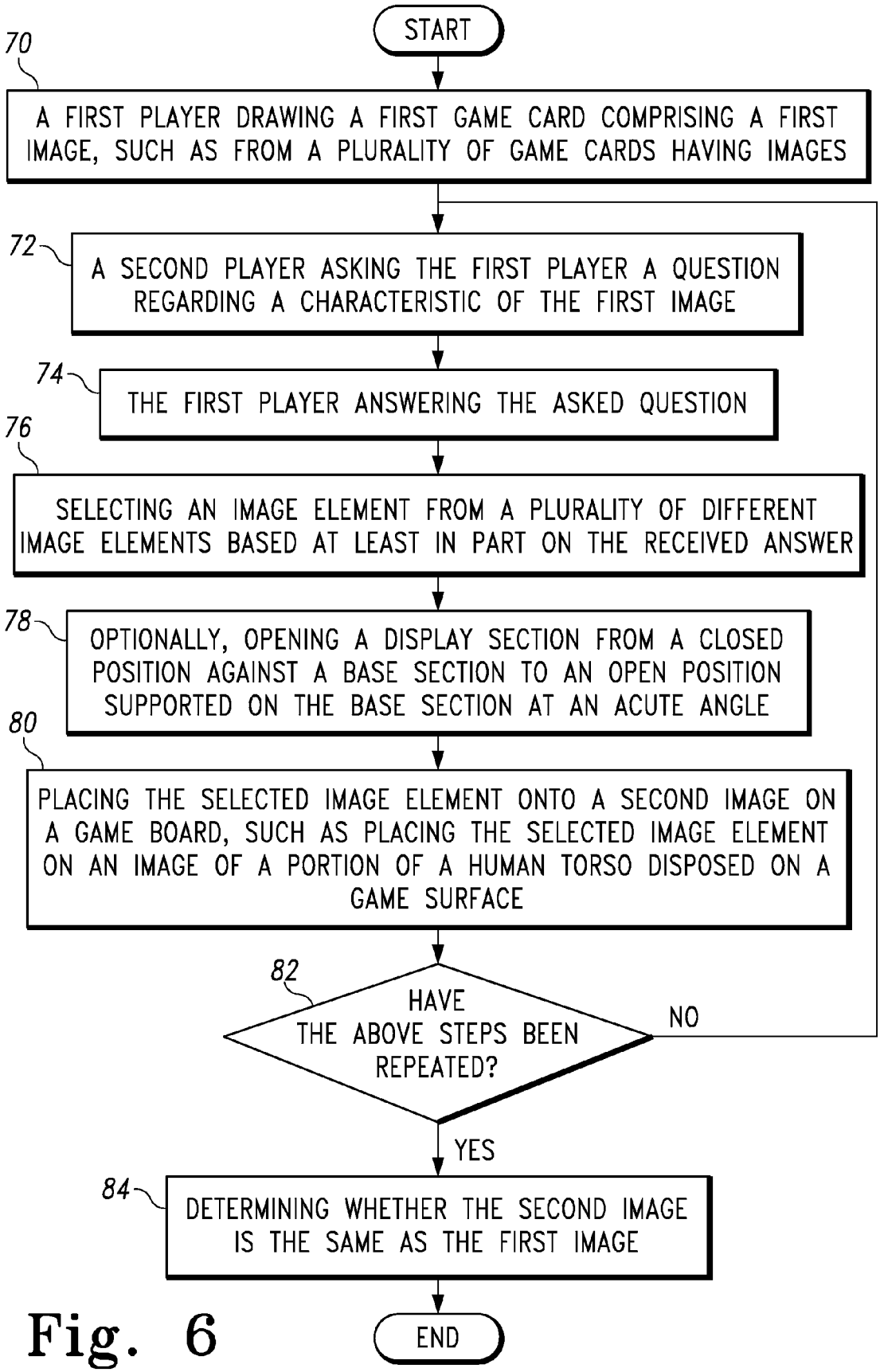
FIG. 6 is a flow chart for another method of playing a game of deduction.

Another example of a method of playing a game of deduction is shown in FIG. 6. The method may include (a) a first player drawing a first game card comprising a first image, such as from a plurality of game cards having images, as indicated in block 70; (b) a second player asking the first player a question regarding a characteristic of the first image, as indicated in block 72; (c) the first player answering the asked question, as indicated in block 74; (d) selecting an image element from a plurality of different image elements based at least in part on the received answer, as indicated in block 76; optionally, opening a display section from a closed position against a base section to an open position supported on the base section at an acute angle, as indicated in block 78; (e) placing the selected image element onto a second image on a game board, such as placing the selected image element on an image of a portion of a human torso disposed on a game surface, as indicated in block 80; (f) if steps (b) through (e) have not been repeated, as indicated in block 82, repeating steps (b) through (e); and (g) after repeating the steps, determining whether the second image is the same as the first image, as indicated in block 84.

What is claimed is:

1. A method of playing a game of deduction, the method comprising the steps of:

(a) asking a question regarding a characteristic of a first image on a card;

(b) receiving an answer to the question;

(c) adding an image element to a second image on a game board based at least in part on the received answer;

(d) repeating the steps of asking, receiving and adding; and (e) after repeating the steps, determining whether the second image is the same as the first image.

2. A method of playing a game of deduction, the method comprising the steps of:

(a) a first player drawing a first game card comprising a first image;

(b) a second player asking the first player a question regarding a characteristic of the first image;

(c) the first player answering the asked question;

(d) selecting an image element from a plurality of different image elements based at least in part on the received answer;

(e) placing the selected image element onto a second image on a game board;

(f) repeating steps (b) through (e); and (g) after repeating the steps, determining whether the second image is the same as the first image.

3. The method of claim 2, wherein drawing a first game card includes drawing the first game card from a plurality of game cards having images.

4. The method of claim 3, wherein the images are configured to appear as at least a human torso.

5. The method of claim 4, wherein the image elements include images of portions of the human torso.

6. The method of claim 4, wherein each game card has a unique image.

7. The method of claim 2, wherein the game board has a base section hingedly attached to a display section having a game surface, the method further comprising:

prior to placing the selected image element, opening the display section from a closed position against the base section to an open position supported on the base section at an acute angle.

8. The method of claim 7, wherein placing the selected image element includes placing the selected image element on an image of a portion of a human torso disposed on the game surface.

* * * * *